United States Patent [19]

Michimae et al.

[11] 4,168,197

[45] Sep. 18, 1979

[54] METHOD OF MANUFACTURING PADDING CLOTH FOR BELTS HAVING A LATENT DIFFERENTIAL SHRINKABILITY PROPERTY

[76] Inventors: Nobuhiro Michimae; Ryuzo Michimae, both of 1219, Ohaza Shinichi, Sinichi-cho, Ashina-gun, Hiroshima-ken, Japan

[21] Appl. No.: 879,065

[22] Filed: Feb. 21, 1978

[30] Foreign Application Priority Data

Feb. 25, 1977 [JP] Japan ..... 52-20537

[51] Int. Cl.[2] ..... B32B 5/08; B32B 5/28

[52] U.S. Cl. ..... 156/283; 8/115.6; 8/115.7; 28/169; 66/190; 156/85; 156/309; 156/320; 427/195; 427/314; 427/372 R; 427/390 R; 428/212; 428/254; 428/259; 428/265; 428/290; 428/343; 428/349

[58] Field of Search ..... 156/84, 283, 325, 309, 156/85, 148, 311, 320; 28/164, 165, 166, 169; 8/115.6, 115.7; 66/190, 85 P; 427/390 R, 390 D, 394, 195, 202, 372 R, 375, 314, 316, 55; 428/252, 254, 258, 259, 265, 272, 212, 290, 343, 347, 349

[56] References Cited

U.S. PATENT DOCUMENTS

| | | | |
|---|---|---|---|
| 2,263,172 | 11/1941 | Heberlein | 428/258 |
| 2,789,340 | 4/1957 | Cresswell | 428/212 |
| 3,073,713 | 1/1963 | Brodeur | 427/394 |
| 3,438,106 | 4/1969 | Cohn et al. | 28/165 |
| 3,507,609 | 4/1970 | Gorrafa | 28/166 |
| 3,570,270 | 3/1971 | Koppenburg | 66/190 |
| 3,642,561 | 2/1972 | Grobner | 428/259 |
| 3,852,090 | 12/1974 | Leonard et al. | 8/115.6 |
| 3,983,282 | 9/1976 | Seeman | 428/212 |

FOREIGN PATENT DOCUMENTS

| | | | |
|---|---|---|---|
| 971434 | 9/1964 | United Kingdom | 156/283 |
| 1087560 | 10/1967 | United Kingdom | 156/283 |

OTHER PUBLICATIONS

Bahlo, "New Fabrics Without Weaving" *American Assn. of Textile Technology Inc.* (Nov. 1965) pp. 51–54.

*Primary Examiner*—Jerome W. Massie
*Attorney, Agent, or Firm*—Blanchard, Flynn, Thiel, Boutell & Tanis

[57] ABSTRACT

Method of manufacturing a padding cloth for belts said cloth having a latent curvability property, in which a belt-like cloth having a plurality of thermal shrinkage rates in the widthwise direction is subjected to heat-treatment under a relaxed condition so as to thermally stabilize the portion of the lowest thermal shrinkage rate, while retaining the residual latent shrinkages of the portions of higher thermal shrinkage rates. An adhesive powder is applied on the cloth and is secured firmly thereto by melting. If required, a supporting cloth having an adhesive applied on its upper face is further superposed on the belt-like cloth and is secured firmly to it with the adhesive of the supporting cloth.

10 Claims, 5 Drawing Figures

METHOD OF MANUFACTURING PADDING CLOTH FOR BELTS HAVING A LATENT DIFFERENTIAL SHRINKABILITY PROPERTY

This invention relates to a process for treating a belt-like cloth adapted to be used as a padding cloth for belts of trousers, pantaloons, slacks, shorts, skirts and the like.

In the following description, the term "latent curvability property" means that a fabric having normally straight side edges is capable of being curved by shrinkage caused by heat treatment so that one of its side edges becomes concave and the opposite side edge becomes convex, i.e., it is capable of assuming a curved or sector shape substantially as appearing in FIG. 4.

Woven cloths and knitted cloths have been conventionally used as such padding cloths, but it is generally accepted that a padding cloth for belts of trousers, skirts, etc. should develop in a sector shape in plan view so as to conform to the waist form of the human body when it is used as a belt and that it should have a three-dimensionally warped curve. For that purpose, various methods of obtaining such sector shape in the production of a padding cloth have heretofore been carried out, for example, by performing a pressing treatment on a base cloth for the padding cloth while stretching one side selvedge of it to deform it into a sector shape, or by sewing or pressing one side selvedge of the cloth while gathering it. These methods, however have some defects, namely, the cloth itself undergoes an unnatural change; cutting loss parts of the cloth are produced; troublesome, inefficient work is required; it is difficult to obtain an ideal warp or curve; and besides, the sector shape is readily restored to the initial shape. Recently, an improvement over the aforementioned methods was attempted, in which a belt-like cloth is prepared by the use of yarns having different shrinkage rates for both the selvedge portions of it. This belt-like cloth is superior in the respect that the cloth itself does not undergo an unnatural change and it is easy to obtain a required curved shape, as compared with conventional padding cloths, but it still has the drawbacks that not only is it difficult to handle the yarns and to control their degrees of contraction, but also the belt-like cloth itself is curved by heating when it is subjected to a finishing adjustment processing, shrink-proofing processing and application of an adhesive resin, so that the surface cloth to be superposed to make a belt must be cut in a curved shape, that is, complicated processing steps are thus required.

We have conducted various investigations in view of the state of the art as mentioned above in order to provide a belt-like cloth, the shrinkage rate of which is easily adjustable and which can be well fitted for the waist shape of the human body. We have succeeded in the development of a belt-like cloth which has a plurality of shrinkage rates, which vary stepwise either increasing or decreasing, across the width of the cloth from one side edge to the other side edge thereof. The difficulty in the manufacture of a belt-like cloth having such distribution of gradually varying shrinkage rates resides in that the contraction occurs owing to heat treatment in the course of the manufacturing process and as a consequence of the contraction, the belt-like cloth takes a sector shape in the course of the process. This fact results in the problems that not only are its last properties for use as a padding cloth for belts, also a deviation is created on the belt-like cloth when it is continuously manufactured, which leads to troubles in the winding-up or other operations. The padding cloth for belts is, after completion, intended to be bonded to the surface cloth of the belt so as to form a complete belt for wearing use. Accordingly, the most preferable requisite for a padding cloth for belts is that the cloth can be readily handled until it is bonded to the surface cloth and attached to the upper margin of trousers, skirts or the like. Then, when it is subjected to a pressing treatment together with the surface cloth, a warped curved sector shape can be obtained conforming to the waist form of the human body.

It is therefore highly desirable that the belt-like cloth having such distribution of gradually varying shrinkage rates in the width direction as afore-mentioned should be treated so as to remain straight so that it can be treated like conventional belt-like cloths while maintaining its latent curving and contracting property in the course of the treating process.

A primary object of this invention is to meet the foregoing need, that is, to provide a method of manufacturing a padding cloth for belts by the use of a belt-like cloth having a distribution of various thermal shrinkage rates which vary stepwise either increasing or decreasing, in the width direction, which padding cloth is capable of retaining its straight state during manufacture and which can be smoothly treated and handled with no trouble in the steps after the heat-treatment.

Another object of this invention is to provide a series of treating steps suitable for obtaining the aforementioned padding cloth for belts, thereby providing a belt-like cloth having a potential for forming a curved sector shape, which cloth can used to make a belt of good shape.

A further subsidiary object of this invention is to cause the thus-obtained padding cloth for belts to exhibit the latent curvability property by bonding it to the surface cloth of the belt and performing heat-treatment, thereby imparting a good curve to the belts of trousers, skirts, etc.

An essential feature of this invention for accomplishing the foregoing objects consists in a method which comprises sizing a continuous belt-like cloth having a distribution of thermal shrinkage rates which vary either increasing or decreasing across the width of the cloth, drying the cloth, for example by winding it on heating rolls at least one time, subjecting it to heat-treatment by means of a heating device wherein the withdrawing rate of the cloth through the outlet is regulated so as to be lower than the supplying rate of the cloth through the inlet so as to be adapted to the lowest shrinkage rate of the cloth to render heat stable the portion of the cloth of the lowest shrinkage rate, and thereafter, transferring the cloth while maintaining its straight state and maintaining the same rate of movement of the cloth as the withdrawing rate at the outlet of the heating device to the end of the apparatus, applying an adhesive powder all over the surface of the cloth, melting the adhesive powder, pressure-bonding the melted adhesive to the cloth by means of water-cooling rolls and winding up the resultant cloth.

The other feature of this invention resides in that after the melting step of the adhesive powder in the above-mentioned method, a supporting cloth composed of a non-woven fabric having an adhesive applied on the outer surface thereof, is superposed onto the belt-like cloth so as to contact the inner surface of the former with the adhesive surface of the latter, and then, both the cloths are pressed together, cooled through water-cooling rolls and wound up.

This invention will be hereinafter described in greater detail with reference to the accompanying drawings, in which.

Figure 1:
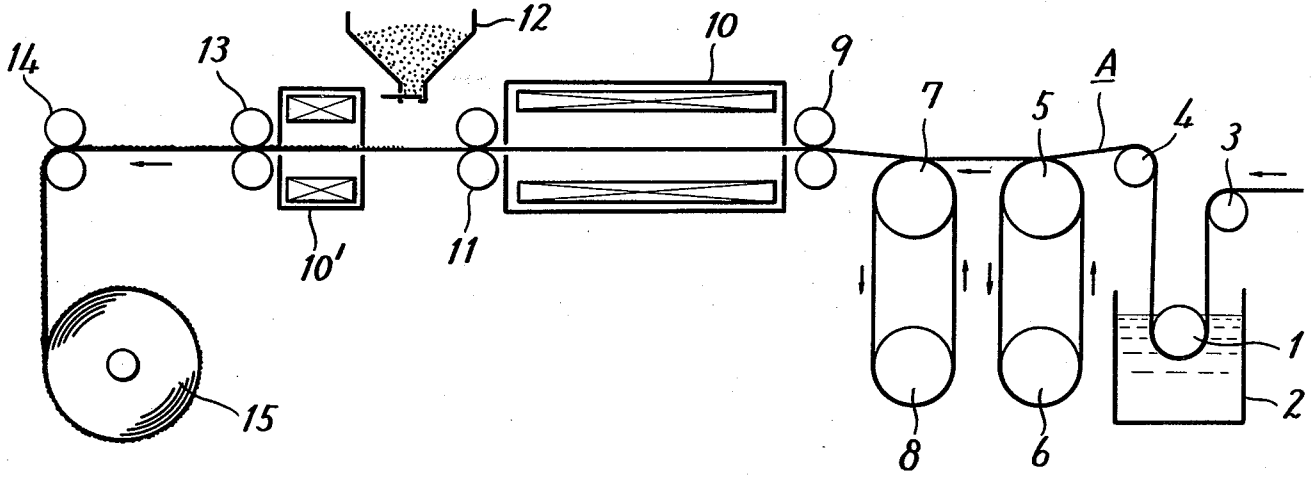
FIG. 1 is a schematic view showing one manufacturing process according to the method of this invention.

Now, referring to FIG. 1, there is shown one embodiment of a process for manufacturing a padding cloth for belts according to the first aspect of this invention which comprises the sequential steps of: passing a belt-like cloth (A) constituting a base of a padding cloth for belts in the state of a continuous long cloth through a sizing bath (2) via a guide roll (3), a sizing roll (1) and second guide roll (4), said belt-like cloth (A) having a distribution of shrinkage rates in the widthwise direction of the cloth, which shrinkage rates vary stepwise either increasing or decreasing; transferring the cloth via supplying rolls (9) into a heating device (10) and withdrawing it out of the device via withdrawing rolls (11); scattering an adhesive powder on the cloth from an adhesive powder container (12); melting the adhesive powder in another heating device (10'); pressure-bonding the melted adhesive to the cloth through water-cooling rolls (13); and subsequently, winding up the thus-obtained cloth via cooling rolls (14) on a roll (15).

Figure 2:
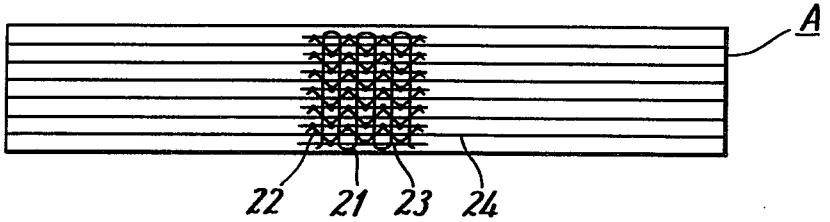
FIG. 2 is a fragmentary plan view showing one example of the starting belt-like cloth used in the method of this invention.

The belt-like cloth (A) constituting a base for a padding cloth for belts which has a distribution of thermal shrinkage rates which vary stepwise, either increasing or decreasing widthwise of the cloth from one side to the other side of the cloth, is, for example, a narrow-width knitted cloth in the form of a continuous long cloth as shown in FIG. 2. On one face or on both faces of the cloth, there is provided a layer of monofilament (21) of a synthetic polymer which monofilament extends transversely to the lengthwise extent of the knitted cloth back and forth between the side edges of the cloth. Zig-zag shaped filaments (22) of a synthetic polymer are disposed lengthwise of the cloth every gauge or every two or more gauges of the cloth. If required, additional lengthwise extending filaments (24) of a synthetic polymer are incorporated in the monofilament layer. The texture thus obtained is knitted securely at the respective gauges with continuous warp knitting stitch yarns (23). In order to provide differences in thermal shrinkage rate in the widthwise direction, as the filament(s) (22) or the stitch yarn (23) or the incorporated additional filament(s) (24), for example, plural groups of filaments or yarns having a higher thermal shrinkage rate and a lower thermal shrinkage rate or having higher, middle and lower thermal shrinkage rates divided widthwise in turn may be used. As the stitch yarn (23), a shrinkable yarn may also be used and machine-sewed as an under thread together with a normal sewing thread (non-shrinkable) as an upper thread, with the number of machine-sewed seam lines or the fineness of the shrinkable yarn being varied between the selvedges and the middle portions of the cloth. Otherwise, for all the above three filaments or yarns or any two of the three, such filaments or yarns having the varying thermal shrinkage rates in the width direction may also be used respectively. Further, the count number of the incorporated filaments (24) may be varied. The narrow-width knitted cloth is thus formed so as to have a distribution of shrinkage rates varying increasingly or decreasingly in the width direction of the cloth.

The filaments (21)(22)(24) constituting the knitted cloth may for example, include nylon, polyester or other synthetic fibers. Particularly, the synthetic polymer filaments (22)(24) are preferably nylon, polyester or synthetic fibers having greater thermal shrinkage rates than the shrinkage rate of the synthetic polymer monofilament (21). Where the cloth is imparted with the different shrinkage rates in the widthwise direction by the constitution of the stitch yarn (23), the stitch yarn may be exemplified by nylon 12 or vinyl chloride series polymers. Similar kinds of fibers may also be used for the incorporating filaments (24) with a view to making such variation in shrinkage rate widthwise, but mainly, vinyl chloride series polymer fibers may be usually used. Here, the vinyl chloride series polymer fibers designated as such may include vinyl chloride polymer fiber, vinyl chloride-vinylidene chloride copolymer fiber or mixed spun fibers of it and any other fiber. In order to vary the respective thermal shrinkage rates of the filaments (22)(24) or yarns (23), the kind of the respective filaments or yarns may be varied or the respective drawing rates of the filaments of the same kind may be varied during production.

In any case, when the resultant cloth is constructed into a belt, the shrinkage difference between the upper and lower edges of the belt is preferred to be in the neighborhood of 5% for a belt of 4 cm wide and a belt having such shrinkage difference can be fitted round the waist part of the human body.

The foregoing sizing treatment of the belt-like cloth (A) facilitates the handling work of the cloth during the manufacturing process and after completion and increases the strength and nerve of the cloth per se. A conventional aqueous resin solution may be applied for the sizing treatment.

The belt-like cloth so sized is subsequently dried through by means of the heating rolls (5)(6)(7)(8) by being wound on a pair of rolls (5)(6) and another pair of rolls (7)(8), at least more than one time, respectively. The temperature of the heating rolls may be varied depending upon the kind of fiber materials constituting the belt-like cloth, but where nylon or polyester fiber is employed, it may be about 160° C. to 170° C. In FIG. 1, two pairs of the heating rolls are shown, but one pair or three pairs or more of rolls may be arranged depending upon the fiber materials used. When plural pairs of rolls are arranged, the temperatures of the respective pairs may be the same or different from each other. Furthermore, a heating chamber containing a pair or pairs of heating rolls may be provided.

The dried belt-like cloth is transferred to the next heating device (10) where a heat-treatment process is performed. This process is very essential in determining the properties of the padding cloth for belts prepared according to the method of this invention. That is, the extent to which the fiber materials constituting the belt-like cloth (A) are thermally stabilized and imparted with a latent contractility are determined by this step of process. In the heating device (10), there is a difference between the supplying rate of the cloth supplied into the inlet and the withdrawing rate of the cloth withdrawn out of the outlet, with the supplying rate being controlled so as to be greater than the withdrawing rate, whereby, the belt-like cloth is subjected to heat-treatment under a relaxed condition or no tension. The relaxing rate is determined by the supplying rolls (9) at the inlet and the withdrawing rolls (11) at the outlet and preferably, is chosen so to be adapted to the lowest thermal shrinkage rate among the various shrinkage rates of the cloth. Thus, in the belt-like cloth so heat-treated, the portion of the lowest thermal shrinkage rate is contracted to its maximum and thereby is thermally stabilized so that the portion is free from further shrinking in the subsequent heat-treatment, e.g. pressing treatment, whereas the portions of the higher thermal shrinkage rates are not so completely stabilized thermally even if they may be contracted to some extent. Thus, the portions of higher thermal shrinkage retain a capability of further shrinking in the subsequent heat-treatment. As far as the appearance of the belt-like cloth thus heat-treated is concerned, however, it may be curled widthwise owing to a shrinkage difference (if any) between the synthetic polymer monofilament layer (21) and the synthetic polymer filaments layer (22), but it never undergoes any lengthwise deformation such as distortion, curvature or the like due to such shrinkage differences in the width direction.

The temperature at which the aforementioned heat-treatment is conducted is naturally required to be a temperature at which the fiber materials are capable of being thermally stabilized and it is usually kept at about 150° C. Since the subsequent heat-treatment is conducted at 120° to 140° C., the portion so thermally stabilized at this step will never shrink.

Now, where both nylon and polyester filaments are used for the stitch yarns (23) and they are stitched on the cloth to provide differences in thermal shrinkage rate among the widthwise portions thereof, the portion of the polyester filaments is so thermally stabilized because of the inherent performance that it will not shrink by the subsequent pressing treatment, whereas the portion of the nylon filaments is not thermally stabilized and retains the capability of residual shrinkage so that it will shrink by the pressing treatment. This is likewise applicable to the case where the constituent filaments of the belt-like cloth (A) comprise either polyester fiber or nylon fiber, and the stitch yarn comprises either nylon or polyester fiber.

After the aforementioned processes, the belt-like cloth still retaining a latent contraction contractability will be wound up in the form of a continuous roll for storage or transportation to the user, but before that, it is preliminarily applied with an adhesive powder such as a heat-sensitive resin powder. That is, after the belt-like cloth thus heat-treated has passed through the withdrawing rolls (11), an adhesive powder is applied all over the surface of it from the adhesive container (12) located at the rear of the rolls. Most usually, scattering means is adopted, but any other conventional means may be optionally used for the application.

The belt-like cloth thus applied with the adhesive is then passed through the second heating device (10') arranged next to the adhesive container (12) to melt the adhesive powder and then is passed between the water-cooling rolls (13) to pressure-bond the melted resin powder to the surface of it. Since the rolls (13) are water cooled, the adhesive never clings to the surfaces of the rolls.

After being passed through the water-cooling rolls (13), the belt-like cloth (A) is cooled in the course of its passage from the rolls (13) to the cooling rolls (14) and it is wound up into a roll 15. These cooling rolls (13)(14) are normally rotated at the same rate as the rate of rotation of the withdrawing rolls (11) in order to transfer the belt-like cloth (A) synchronously. During this step, it is essential that the belt-like cloth be transferred in a straight state in spite of the fact that it retains the capability of residual shrinkages in the portions having higher thermal shrinkage rates.

The belt-like cloth wound up on the roll (15) and completed may be used for the production of trousers, skirts and the like by sewing work, in which it is superposed onto the surface cloths of the belts and heat-treated by pressing to exhibit the latent shrinking property.

The construction for achieving such distribution of gradually varying shrinkage rates of the belt-like cloth to be used in this invention will be described and exemplified in the following. Taking both the textural shrinking resistance of the belt-like cloth and the shrinking resistance of the surface cloths into consideration, the belt-like cloth is required to have a considerably high shrinking force, and to be easily handled from the viewpoint of production control and thermal control. Accordingly, the most preferred construction from the aforementioned viewpoints of the belt-like cloth is, for example, that the belt-like cloth is comprised of polyester filaments as the stitch filaments 23 and mixed-spun filaments of a vInyl chloride type polymer which has a high shrinkage rate and polyester, for example, "Vindene" (trademark of a product manufactured by Teijin Kabushiki Kaisha, Japan) as the incorporated filaments 24. According to this construction, the belt-like cloth consists of three sections which are divided widthwise and in which one side section, the middle section and the other side section are incorporated with polyester filaments, "Vindene" every two gauges or more and "Vindene" in every gauge, respectively, and the sections are stitched securely with the polyester stitch filaments 23. Further, it is possible to easily obtain any shrinkage difference as desired by freely varying the ratio of the widths of the three sections.

The reason why the use of "Vindene" is preferred is that polyvinyl chloride fiber solely composed of 100% vinyl chloride might be an ideal fiber in the respect that it has a high shrinking ability and a weak heat-setting ability and begins to shrink at 60° to 80° C., but it might be so difficult to control thermally because of its weak resistance to high temperature that breakage at the melting may sometimes occur above 120° C. In this respect, the aforementioned "Vindene" has an advantage that its heat resistance is so enhanced by mix-spinning with the heat-resistant fiber that it withstands well the heat-treatment process and facilitates the temperature control. On the other hand, the polyester filament as a warp stitch yarn 23 has a heat-settability and may be set even at the drying step. Particularly, where the drying is conducted above 150° C., no shrinking occurs in the subsequent heat-treatments, i.e. on adhesive application and on pressing treatment of the completed belt-like cloth and a surface cloth since the temperatures of the heat-treatments are from 120° to 150° C. and no particular heating for heat-setting is necessary.

Figure 3:
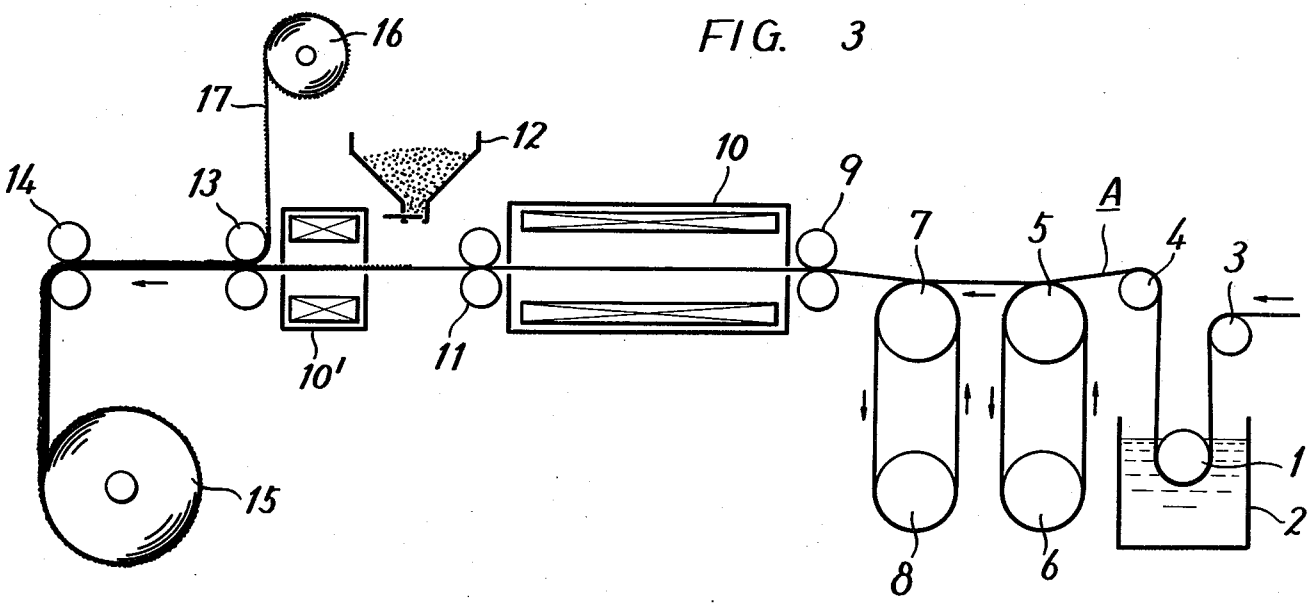
FIG. 3 is a schematic view showing another manufacturing process according to this invention.

FIG. 3 shows one embodiment of the method according to the second aspect of this invention.

The process according to this aspect of the invention is carried out in a similar manner to the process according to the first aspect of this invention as far as the following steps are concerned. A belt-like cloth (A) in the form of a continuous long cloth is passed through the guide roll (3), the sizing bath (2), second guide roll (4), the drying rolls comprising the heating rolls (5)(6)(7)(8), supplied through the supplying rolls (9) into the heating device (10), withdrawn out of the withdrawing rolls (11), an adhesive powder supplied from the adhesive powder container (12) is scattered thereon and the cloth is passed through the second heating device (10') to melt the adhesive. But thereafter, a supporting cloth (16), for example, a non-woven fabric coated with an adhesive (17) on its outer face, is applied onto the belt-like cloth (A) at the intermediate position between the second heating device (10') and the water-cooling rolls (13) and superposed together so that the inner face of the former may contact with the adhesive face of the latter; both the cloths are pressed together by the water-cooling rolls (13) and are bonded together with the melted adhesive secured to the belt-like cloth (A) while the adhesive on the outer face of the supporting cloth (16) is secured firmly thereto. The integral superposed cloth assembly is subsequently cooled and wound up. Here, it is preferred at the position where the supporting cloth, e.g. a non-woven cloth being supplied, is superposed onto the belt-like cloth, that funnel-form cloth-leading tubes (not shown) may be arranged, whereby the respective positions to be superposed can be set exactly without any special technique.

Figure 5:
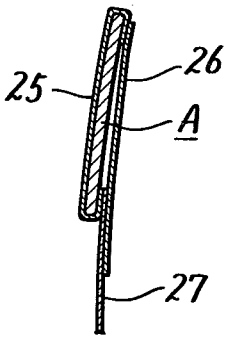
FIG. 5 is a sectional view taken along the line X—X of FIG. 4.
Figure 4:
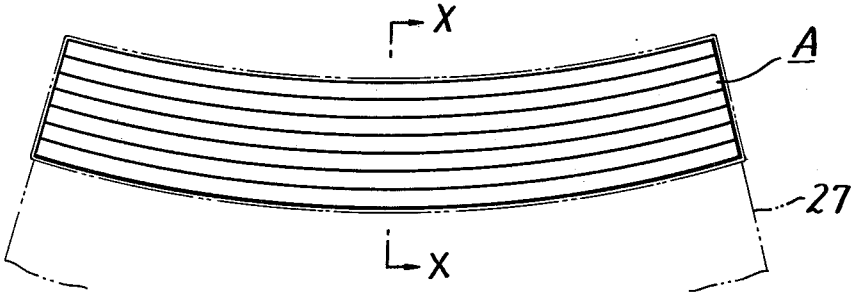
FIG. 4 is a view of one embodiment where the padding cloth thus manufactured according to the method of this invention is curved so that it can be practically used as a padding cloth for belts.

FIGS. 4 and 5 show one embodiment of the practical application to a padding cloth of the belt-like cloth (A) having a latent warping curvability property as mentioned above thus obtained according to this invention, in which the padding cloth is cut into a required length, attached on and sewed to the upper margin of the main part (27) of trousers or a skirt and is heat-treated by pressing, whereby the padding cloth is deformed into a curved sector shape.

The attachment of the padding cloth as shown in FIG. 5 is performed by placing the adhesive face of the cloth onto the back-side of a surface cloth (25) for a belt, sewing both cloths on the upper part of the main body (27) together with a back lining cloth (26) and heat-treating all the cloths by pressing. As a consequence of the heat-treatment, the padding cloth is securely bonded with the surface cloth by the melting of the adhesive and simultaneously exhibits its residual shrinking property to finally present a curved sector shape. When the padding cloth for belts so attached and incorporated in the belts of trousers, skirts, etc. is then heat-treated by one stroke of pressing, the resulting belts can be readily fitted to the waist form of a wearer. One embodiment is described hereinabove in which after the sewing work, the belt is bonded, contracted and deformed into a sector shape simultaneously with the heat-treatment by the finishing pressing, but it is also possible to preliminarily bond the padding cloth and the surface cloth together by heating and simultaneously to cause the former to shrink to prepare a warped waist belt and thereafter to attach it to the upper margin of the main part (27) together with the back lining cloth (26).

To sum up, according to the method of this invention, in order to provide a padding cloth for belts readily capable of imparting the belts of trousers, skirts, etc. with a curved sector shape suitable for belts, the thermal shrinkage rates in the width direction of the cloth are varied stepwise and the padding cloth is contracted to be adapted to the lowest thermal shrinkage rate, whereby a residual shrinking potentiality is retained in the portions of higher thermal shrinkage rates, so that the cloth can be subjected to the subsequent treatments to the end which being maintained in a straight state as a whole without any deformation. Consequently, the treatment and handling of the padding cloth for belts may be facilitated and conducted smoothly not only when the cloth is manufactured, but also when it will be transported to manufacturers of sewed articles in the form of a continuous long belt. Further, when the padding cloth is constructed into the belts of trousers, skirts, etc. the cloth can be deformed to a sector shape at a stroke simultaneously with the melting of the adhesive by the heat-treatment of pressing, so that the present method is very effective in rationalizing the construction of the padding cloth into belts of trousers, skirts, etc. Moreover, the method of this invention is very practical since the belt-like cloth as a base for padding cloth can be treated continuously and accordingly, uniformization of the quality as well as enhancement of the productivity can be attained.

What is claimed is:

1. A method of manufacturing a padding cloth for belts, wherein said cloth has a latent curvability property such that it can be deformed by differential shrinkage caused by heat treatment so that one of its side edges becomes concave and its opposite side edge becomes convex, which comprises the steps of: applying a liquid fabric sizing composition to a continuous belt-like cloth having thermal shrinkage rates which vary stepwise across the width of said cloth so as to increase toward a side edge of said cloth to impart said latent curvability property thereto; then drying said sized cloth; then moving said dried, sized cloth into and through a heating device and heating said cloth therein, the dried, sized cloth being moved into said heating device at a faster rate than the rate at which it is withdrawn from said heating device so that said cloth is in a relaxed state during its passage through said heating device and the portion of said cloth having the lowest thermal shrinkage rate is thereby shrunk to the maximum extent in said heating device so that said portion is thermally stabilized and is not capable of further shrinkage while the other portions of said cloth having higher thermal shrinkage rates remain not completely thermally stabilized and capable of further shrinkage; then applying adhesive powder to an entire surface of said heat-treated, dried, sized cloth; then melting said adhesive powder; then pressing the melted adhesive into said cloth to bond it to said cloth; then cooling said cloth to solidify said adhesive; and then winding-up said cloth on a roll in a straight state.

2. A method according to claim 1 wherein said belt-like cloth is an elongated knit cloth of narrow width, said knit cloth having on one or both surfaces thereof a layer comprised of synthetic polymer monofilament which is bent to provide legs which are longitudinally spaced on said knit cloth and which extend transversely to the lengthwise extent of said knit cloth, the adjacent ends of the legs being connected by reversely curved end portions so that said monofilament extends back-and-forth between the side edges of said knit cloth, zig-zag-shaped filaments of a synthetic polymer which extend generally lengthwise of said knit cloth at every gauge thereof, said zig-zag filaments crossing said monofilament and extending diagonally on their respective associated gauges, straight filaments of synthetic polymer extending lengthwise of said knit cloth at said gauges, and stitch yarns stitched to said knit cloth at the respective gauges thereof for securing said monofilament, said zig-zag filaments and said straight filaments to said knit cloth.

3. A method according to claim 2 in which the variation of thermal shrinkage rate is determined by the characteristics of at least one of said zig-zag filaments, said straight filaments and said stitch yarns, each of which is comprised of a synthetic fiber having high thermal shrinkage rate.

4. A method according to claim 2 wherein said stitch yarn is made of polyester filament and said straight filament is a mixed-spun filament of polyvinyl chloride fiber and polyester fiber.

5. A method according to claim 3 in which said stitch yarn is a yarn having a high thermal shrinkage rate and which is machine sewed as an under thread on said knit cloth.

6. A method of manufacturing a padding cloth for belts, wherein said cloth has a latent curvability property such that it can be deformed by differential shrinkage caused by heat treatment so that one of its side edges becomes concave and its opposite side edge becomes convex, which comprises the steps of: applying a liquid fabric sizing composition to a continuous belt-like base cloth having thermal shrinkage rates which vary stepwise across the width of said base cloth so as to increase toward a side edge of said base cloth to impart said latent curvability property thereto; then drying said sized base cloth; then moving said dried, sized, base cloth into and through a heating device and heating said base cloth therein, the dried, sized, base cloth being moved into said heating device at a faster rate than the rate at which it is withdrawn from said heating device so that said base cloth is in a relaxed state during its passage through said heating device and the portion of said base cloth having the lowest thermal shrinkage rate is thereby shrunk to the maximum extent in said heating device so that said portion is thermally stabilized and is not capable of further shrinkage while the other portions of said base cloth having higher thermal shrinkage rates remain not completely thermally stabilized and capable of further shrinkage; then applying adhesive powder to an entire surface of said heat-treated, dried, sized, base cloth; then melting said adhesive powder; then superimposing the inner face of a supporting cloth on said adhesive-coated face of said base cloth, said inner face of said supporting cloth being free of adhesive, the outer face of said supporting cloth being coated with an adhesive; then pressing said cloths together to bond them together by the adhesive coating on said base cloth and simultaneously to secure to said supporting cloth the adhesive on the outer face thereof; then cooling the assembly of said base cloth and said supporting cloth to solidify the adhesive coating on said base cloth; and then winding-up said assembly of said base cloth and said supporting cloth on a roll in a straight state.

7. A method according to claim 6 wherein said belt-like cloth is an elongated knit cloth of narrow width, said knit cloth having on one or both surfaces thereof a layer comprised of synthetic polymer monofilament which is bent to provide legs which are longitudinally spaced on said knit cloth and which extend transversely to the lengthwise extent of said knit cloth, the adjacent ends of the legs being connected by reversely curved end portions so that said monofilament extends back-and-forth between the side edges of said knit cloth, zig-zag-shaped filaments of a synthetic polymer which extend generally lengthwise of said knit cloth at every gauge thereof, said zig-zag filaments crossing said monofilament and extending diagonally on their respective associated gauges, straight filaments of synthetic polymer extending lengthwise of said knit cloth at said gauges, and stitch yarns stitched to said knit cloth at the respective gauges thereof for securing said monofilament, said zig-zag filaments and said straight filaments to said knit cloth.

8. A method according to claim 7 in which the variation of thermal shrinkage rate is determined by the characteristics of at least one of said zig-zag filaments, said straight filaments and said stitch yarns, each of which is comprised of a synthetic fiber having high thermal shrinkage rate.

9. A method according to claim 7 wherein said stitch yarn is made of polyester filament and said straight filament is a mixed-spun filament of polyvinyl chloride fiber and polyester fiber.

10. A method according to claim 8 in which said stitch yarn is a yarn having a high thermal shrinkage rate and which is machine sewed as an under thread on said knit cloth.

* * * * *